US006123598A

United States Patent [19]

Cook

[11] Patent Number: 6,123,598

[45] Date of Patent: Sep. 26, 2000

[54] HAND HELD DOLL HAVING PULLSTRING DRIVEN JAWS

[75] Inventor: Robynn M. Cook, Aliso Viejo, Calif.

[73] Assignee: Mattel, Inc., El Segundo

[21] Appl. No.: 09/245,187

[22] Filed: Feb. 5, 1999

[51] Int. Cl.[7] ..... A63H 13/00

[52] U.S. Cl. ..... 446/337; 446/352

[58] Field of Search ..... 446/268, 323, 446/331, 337, 352, 353, 358, 330

[56] References Cited

U.S. PATENT DOCUMENTS

| | | | |
|---|---|---|---|
| 921,364 | 5/1909 | Clark . | |
| 3,060,631 | 10/1962 | Collischan . | |
| 3,698,127 | 10/1972 | Harp . | |
| 3,745,696 | 7/1973 | Sapkus et al. . | |
| 3,996,695 | 12/1976 | Sapkus et al. . | |
| 4,232,478 | 11/1980 | Terzian . | |
| 4,244,139 | 1/1981 | Erickson et al. . | |
| 4,268,990 | 5/1981 | Kubiatowicz . | |
| 4,575,347 | 3/1986 | Kitamura | 446/301 |
| 4,695,265 | 9/1987 | Clark . | |
| 4,820,232 | 4/1989 | Takahashi et al. . | |
| 5,092,811 | 3/1992 | Bergenguer . | |
| 5,094,645 | 3/1992 | Stern et al. | 446/370 |
| 5,125,865 | 6/1992 | Orenstein et al. . | |
| 5,145,445 | 9/1992 | Northey . | |
| 5,162,012 | 11/1992 | Blandi et al. . | |
| 5,304,087 | 4/1994 | Terzian et al. . | |
| 5,320,573 | 6/1994 | Matsuyama | 446/358 |

*Primary Examiner*—Robert A. Hafer
*Assistant Examiner*—Laura Fossum
*Attorney, Agent, or Firm*—Roy A. Ekstrand

[57] ABSTRACT

A hand held doll includes a pivotally supported nose and upper jaw upon a head which is supported by a torso. A mechanism within the torso utilizes a pullstring drive to rotate a drum. The drum defines an angled slot which receives one end of a pivotable lever. A link couples a pivotable lever to an arm which pivotally supports the nose and upper jaw of the doll.

4 Claims, 2 Drawing Sheets

HAND HELD DOLL HAVING PULLSTRING DRIVEN JAWS

FIELD OF THE INVENTION

This invention relates generally to dolls and toy figures and particularly to those having a spring driven movement feature.

BACKGROUND OF THE INVENTION

Dolls and toy figures have enjoyed a continuous and long term popularity among children of a vary broad age range. This long term popularity and continuing interest have prompted practitioners in the art to provide a virtually endless variety of dolls and toy figures. Many dolls and toy figures are active and perform in a manner generally mimic human actions. As a result, dolls and toy figures have been provided which perform activities such as walking, crawling, swimming, skating, or fighting to name just a few. In addition to activity functions, the advent to low cost miniature microprocessors and speech circuits has stimulated the introduction of sound related actions in dolls and toy figures such as talking, laughing, singing or crying.

Not surprisingly, such dolls and toy figures vary dramatically in the appearance which they present. Thus dolls and toy figures provide appearances that range from vary realistic to extremely fanciful and often exaggerated appearances. Also some dolls and toy figures have appearances which are decidedly unrealistic such as exaggerated monsters on one extreme or cartoon characters at the other. For example, U.S. Pat. No. 5,145,445 issued to Northey sets forth a HEAD AND JAW ACTUATION DEVICE for use in a puppet to provide motion of the mouth and head to simulate mouth movement during speaking.

U.S. Pat. No. 3,698,127 issued to Harp sets forth a DOLL-LIKE PUPPET WITH MOVEABLE MOUTH having a spherical head defining a moveable mouth operated by a pullstring. The string is attached to the lower jaw. The head is supported upright on a rod extending downward therefrom such that the lower end of the rod may be gripped by the user while the jaw is manipulated by the pullstring.

U.S. Pat. No. 4,695,265 issued to Clark sets forth a PUPPET APPARATUS bulbous body supporting a static beak and a moveable beak and generally resembling a bird. A push-pull mechanism operable by the users thumb is coupled to the moveable beak to provide the illusion of talking by the puppet.

U.S. Pat. No. 5,125,865 issued to Orenstein et al. sets forth a TOY DOLL CONSTRUCTION having a body and animated mechanism in the doll body. The doll body includes a head portion having a resilient flexible mouth section and means for distorting the resilient mouth to simulate speech.

U.S. Pat. No. 4,820,232 issued to Takahashi et al. sets forth a VOICE MAKING DEVICE FOR MOVING ANIMAL TOY AND MOVING ANIMAL TOY USING THE VOICE MAKING DEVICE having a toy animal figure which supports a battery powered fan mechanism operative to draw air into the toy interior. The flow of air is passed over a voice generating member having a vibrating piece therein and is further directed to apparatus for moving the toy figure.

U.S. Pat. No. 5,092,811 issued to Bergenguer sets forth a MECHANISM FOR THE CRYING AND SUCKING MOTION OF DOLLS having an eccentrically mounted shaft which is secured to one end of a spring having its remaining end connected to a portion of a doll face. A pacifier is inserted into the mouth of the doll opening the switch and activating all devices. When the pacifier is removed the voice device is activated.

U.S. Pat. No. 4,244,139 issued to Erickson et al. sets forth a EATING DOLL having a flexible head defining a mouth and lips therein. A pair of calipers pivotally coupled within the doll interior provide a set of jaws moving the lips in response to the squeezing of the doll torso.

U.S. Pat. No. 3,745,696 issued to Sapkus et al. sets forth a DOLL HAVING MEANS FOR CHANGING FACIAL EXPRESSION UPON TURNING OF HEAD and U.S. Pat. No. 3,996,695 issued to Sapkus et al. sets forth a SNEEZING DOLL both of which are illustrative of mouth moving mechanisms for dolls.

U.S. Pat. No. 4,268,990 issued to Kubiatowicz sets forth a TOY ACTIVATING MECHANISM having a novelty item supporting a pair of jaw and teeth assembly in a pivotal attachment facilitating opening and closing movement of the jaws of the novelty device.

U.S. Pat. No. 5,304,087 issued to Terzian et al. sets forth a SOFT STUFFED TOY WITH MANUALLY DRIVEN HEAD EARS AND/OR TONGUE. While U.S. Pat. No. 5,162,012 issued to Blandi et al. sets forth a MUSICAL PULLSTRING TOY which are generally related to mouth movement in dolls in toy figures.

While the foregoing described prior art devices have improved the art and in some instances enjoyed commercial success there remains nonetheless a continuing need in the art for evermore improved, interesting and entertaining hand held dolls

SUMMARY OF THE INVENTION

Accordingly, it is a general object of the present invention to provide an improved hand held doll. It is a more particular object of the present invention to provide an improved hand held doll having a rapidly moving teeth chomping action which is achieved without the need for complex and expensive components.

In accordance with the present invention there is provide a hand held doll comprising: a body having a supporting base, a head and a nose supporting and upper jaw; a housing supported within the body having a first pivotally supported lever have and outer end coupled to the nose and an interior end; a pullstring drive means supported within the housing having a string reel and a string wound thereon, the body defining an aperture through which a portion of the string extends from the body, the pullstring drive means also including a spiral wound spring operatively coupled to the string reel urging the string reel toward winding the string; and cam means rotationally coupled to the pullstring drive means having a rotatable cam and a pivotally supported cam follower and an elongated link having one end coupled to the cam follower and the other end to the interior end of the first pivotally supported lever.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
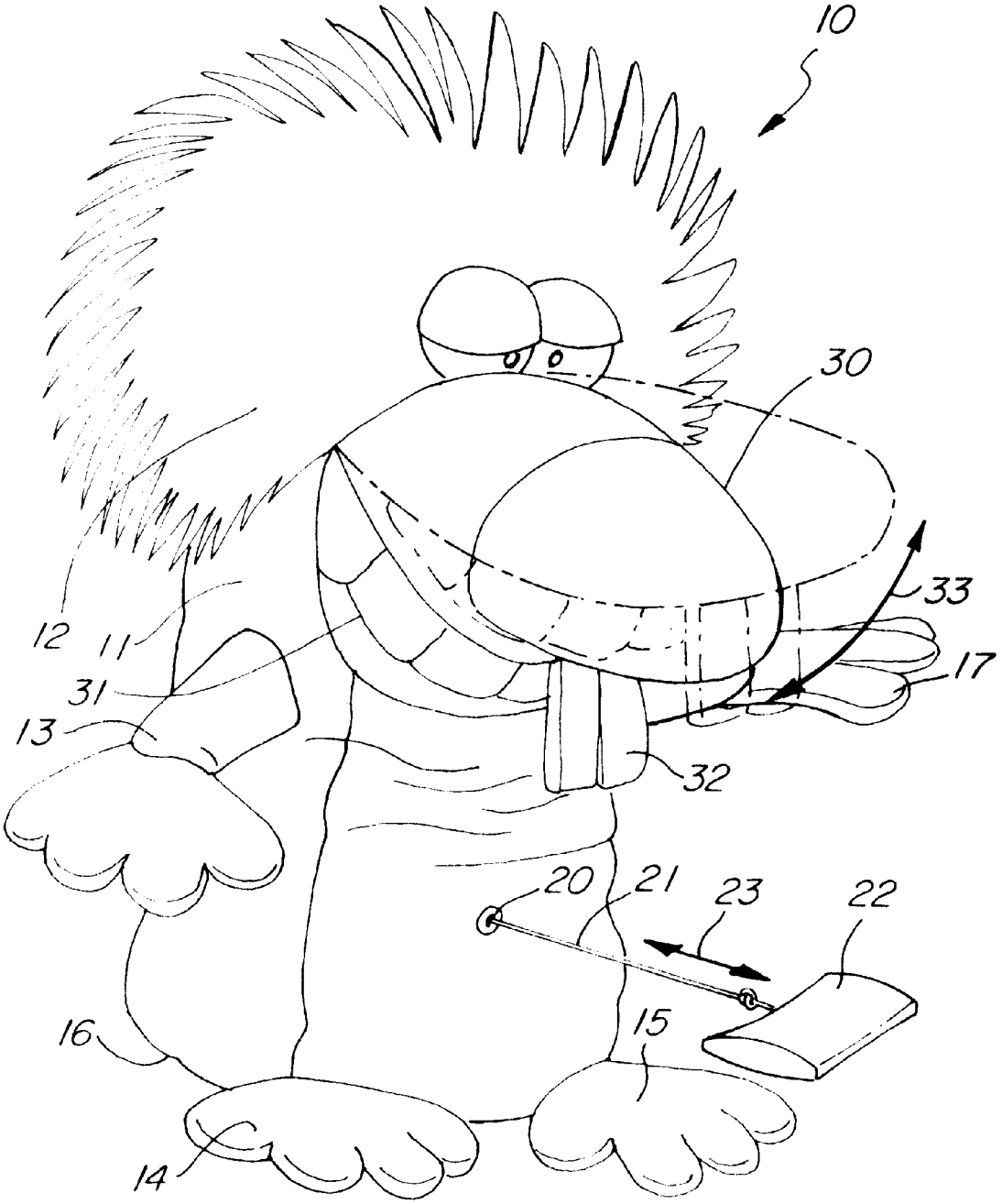
FIG. 1 sets forth a front perspective view of a hand held doll constructed in accordance with the present invention.

FIG. 1 sets forth a front perspective view of a hand held doll constructed in accordance with the present invention and generally referenced by numeral 10. Doll 10 is formed as a plush figure having a body 11 fabricated of a flexible fabric material and supporting a quantity of soft packing material within body 11. It will be apparent to those skilled in the art that the appearance and fabrication of body 11 of doll 10 is set forth herein for purposes of illustration and that the invention is not limited to either the appearance or outer fabrication of doll 10. As used herein the term "doll" will be understood to include dolls and toy figures of the various types provided by practitioners in the art.

More specifically, doll 10 includes a body 11 having a flexible fabric outer surface and supporting a head 12, a pair of arms 13 and 17, a pair of feet 14 and 15 and a bottom resting surface 16. In accordance with the present invention a nose 30 supporting a upper jaw 31 and a plurality of simulated teeth 32 is pivotally supported by drive means seen in FIG. 2. Suffice it to note here, that nose 30 is pivotally moveable in the directions indicated by arrows 33.

Figure 2:
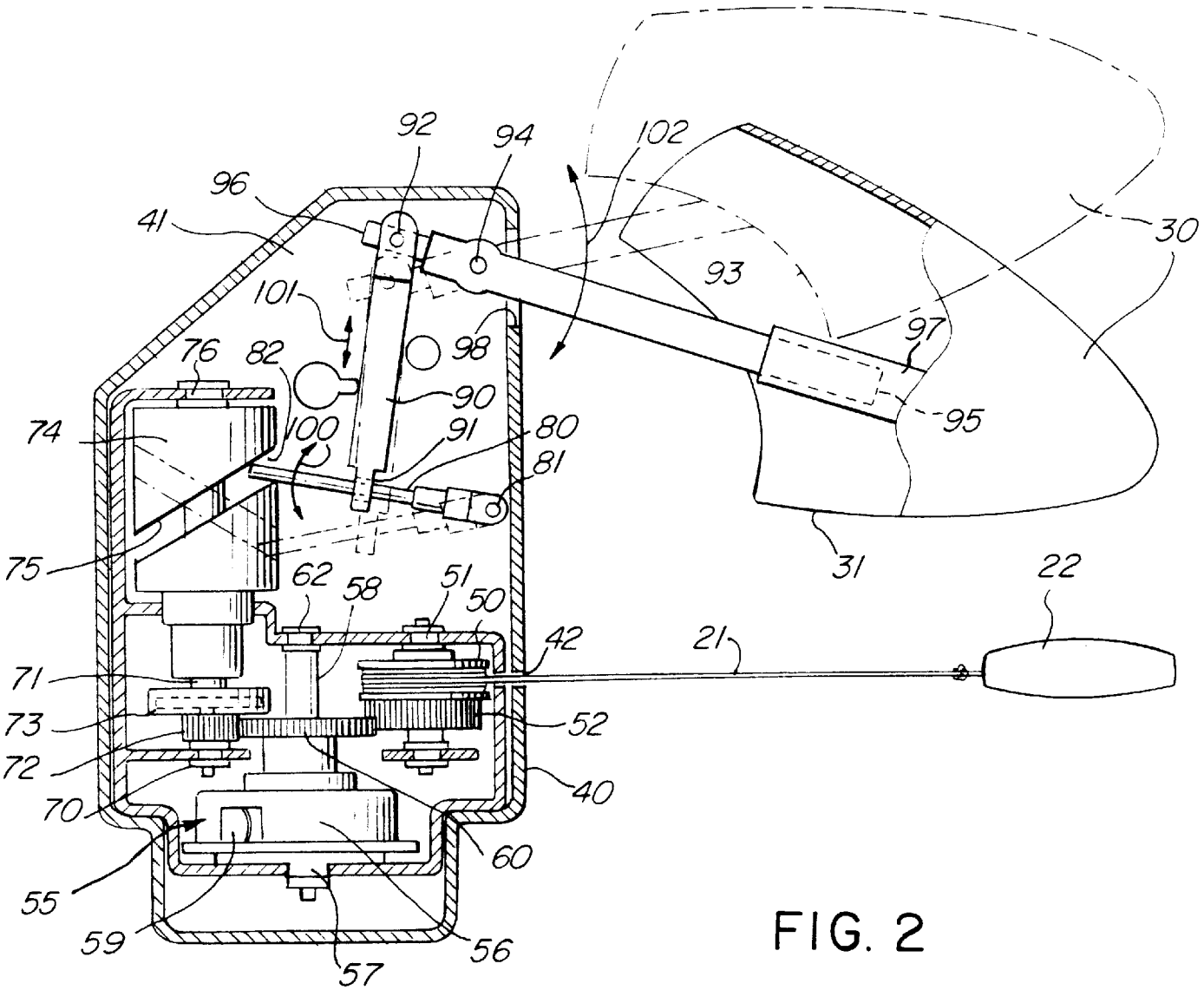
FIG. 2 sets forth a section view of the operative mechanism within the present invention hand held doll.

In further accordance with the present invention and is better seen in FIG. 2, doll 10 includes an internal pullstring drive mechanism which is operatively coupled to nose 30 causing nose 30 and upper jaw 31 to be oscillated as indicated by arrows 33.

In operation, the user simply grasps body 11 where convenient and draws grip 22 and pullstring 21 outwardly. As pullstring 21 is drawn outwardly through aperture 20 the pullstring drive mechanism set forth below in FIG. 2 moves nose 30 in the manner indicated by arrows 33. Once pullstring 21 has been drawn outwardly its full distance, the user releases grip 22 and the internal drive string mechanism (seen in FIG. 2) causes nose 30 to move up and down rapidly in the directions indicated by arrow 33.

FIG. 2 sets forth a partial section view of the operative pullstring mechanism of the present invention doll together with a portion of nose 30. A housing 40 defines an interior cavity 41 within which a pulley 50 is supported. An aperture 42 is formed in general alignment with pulley 50 and a quantity of string 21 is wound upon pulley 50. The outer end of string 21 is secured to a grip 22. Pulley 50 is supported by shaft 51 within housing 40 and is further jointed to a gear 52.

A coil spring drive 55 includes an housing 56 secured to housing 40 by a lock 57. Coil spring drive 55 further includes an output shaft 58 supported by a baring 62 upon housing 40 and a gear 60. Gear 60 engages gear 52 of pulley 50. Coil spring 59 is supported upon housing 56 and in accordance with conventional fabrication techniques is wound about shaft 58 to provide coil spring force when shaft 58 is rotated to wind spring 59.

A cam drum 74 defines an angled slot 75 and a baring 76. Baring 76 rotatably supports drum 74 within housing 40. Drum 74 is rotatingly supported by a shaft 71 which in turn is coupled to a clutch mechanism 73. Clutch mechanism 73 is further coupled to a gear 72. A baring 70 supports the bottom end of gear 72. Gear 72 also engages gear 60.

A lever 80 is pivotally supported within housing 40 by a pivot pin 81 and includes an end 82 received within slot 75 of drum 74. As drum 74 rotates end 82 is moved successively downwardly and upwardly in pivotal movement as end 82 is carried by slot 75. An elongated link 90 includes a coupler 91 having a passage through which lever 80 extends and an upper end having a pivot 92 secured thereon. An arm 93 extends through aperture 98 formed in housing 40 and is pivotally secured within housing 40 by a pivot pin 94. Arm 93 defines an outer end 95 and an interior end 96. End 96 is pivotally secured to link 90 by a pivot pin 92. Nose 30 of doll 10 (seen in FIG. 1) defines an internal sleeve 97 which receives and is secured to end 95 of arm 93.

In operation the user draws grip 22 and pullstring 21 outwardly causing pulley 50 to rotate. The rotation of pulley 50 rotates gear 52 which is engaged with gear 60 and thus causes a corresponding rotation of gear 60. Coil spring drive 55 is arranged to provide a winding of spring 59 as string 21 is drawn outwardly from pulley 50. Thus spring 59 provides a spring force urging rotation of pulley 50 against the outward movement of string 21 and urging pulley 50 toward rewinding string 21.

Once grip 22 and string 21 have been drawn outwardly from housing 40 and a substantial portion of the string upon pulley 50 has been drawn outwardly, the user may then simply release grip 22 allowing coil spring drive 55 to rotate gear 60 and gear 52 to correspondingly rotate pulley 50 and wind string 21 upon pulley 50.

Thus gear 60 is alternately rotated in one direction as string 21 is drawn outwardly and is rotated in the opposite direction as string 21 is allowed to return under the urging of spring 59 to be again wound upon pulley 50. Gear 60 engages gear 72 and produces a corresponding rotation thereof. For the most part, clutch 73 directly couples gear 72 to shaft 71. The function of shaft 73 is to protect the pullstring mechanism utilized in the present invention doll from excessive loads or resisting forces.

With clutch 73 in the coupled state, the rotation of gear 72 produces a corresponding rotation of shaft 71 which in turn rotates drum 74. As drum 74 rotates end 82 of lever 80 is carried within slot 75 pivoting lever 80 in the manner indicated by arrow 100. The stability of support for drum 74 is enhanced by the use of baring 76.

As lever 80 moves in a pivotal fashion about pin 81 in the manner indicated by arrows 100, link 90 is moved upwardly and downwardly as indicated by arrows 101. The pivotal attachment between end 96 of arm 93 and link 90 utilizing pivot 92 results in a corresponding pivotal movement of arm 93 about post 94 as link 90 is moved up and down. The pivotal movement of arm 93 carries nose 30 during its motion and as a result arm 93 and nose 30 pivotally moved about pivot 94 in the direction indicated by arrows 102.

Thus the user is able to activate the rapid mouth movement or "chomping" action of the present invention doll by simply drawing and releasing string 21 using grip 22.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A hand held doll comprising:

a body having a supporting base, a head and a nose supporting a upper jaw;

a housing supported within said body having a first pivotally supported lever having an outer end coupled to said nose and an interior end;

a pullstring drive means supported within said housing having a string reel and a string wound thereon, said body defining an aperture through which a portion of said string extends from said body, said pullstring drive means also including a spiral wound spring operatively coupled to said string reel urging said string reel toward winding said string;

a cam drum having a generally cylindrical surface defining a continuous slot therein;

a gear drive coupled to said pullstring drive means and said cam drum for rotating said cam drum as said string is pulled and released;

a cam follower pivotally supported by said housing having a follower end received in said continuous slot; and an elongated link having a first end coupled to said cam follower and a second end to said interior end of said first pivotally supported lever, said pullstring drive causing said gear drive to rotate said cam drum as said string is pulled and released which causes said cam follower to pivot up and down causing said elongated link to reciprocate and pivot said first pivotally supported lever.

2. The hand held doll set forth in claim 1 wherein said elongated link defines an aperture at said one end and wherein said cam follower extends through said aperture.

3. The hand held doll set forth in claim 2 wherein said rotatable cam drum includes a clutch coupled between said pullstring drive means and said drum.

4. The hand held doll set forth in claim 3 wherein pullstring includes an enlarged grip.

* * * * *